US005484971A

United States Patent [19]

Gonzalez et al.

[11] Patent Number: 5,484,971

[45] Date of Patent: Jan. 16, 1996

[54] ELECTRICAL CONTACT HAVING A PRECIOUS METAL EXTRUSION EXTENDING FROM A CONTACT SURFACE

[75] Inventors: Raphael A. Gonzalez, Sterling; Ronald W. Kelly, Morrison, both of Ill.

[73] Assignee: General Electric Company, Fort Wayne, Ind.

[21] Appl. No.: 678,503

[22] Filed: Apr. 1, 1991

Related U.S. Application Data

[62] Division of Ser. No. 475,916, Feb. 6, 1990, Pat. No. 5,020, 217.

[51] Int. Cl.[6] ..... H01H 1/06

[52] U.S. Cl. ..... 200/279; 200/267

[58] Field of Search ..... 200/279, 269, 200/268, 267

[56] References Cited

U.S. PATENT DOCUMENTS 2,199,240 4/1940 Gwyn, Jr. ..... 200/268

3,293,399 12/1966 Heinrich ..... 200/267 X 4,074,112 2/1978 Runft ..... 200/279

4,745,244 5/1988 Spinner ..... 200/279 X

FOREIGN PATENT DOCUMENTS 1278032 9/1968 Germany ..... 200/279

*Primary Examiner*—Henry J. Recla
*Assistant Examiner*—David J. Walczak
*Attorney, Agent, or Firm*—Ralph E. Krisher, Jr.

[57] ABSTRACT

An electrical contact comprises a body formed of a precious metal in which the precious metal defines a contact surface of the body. At least one projection of the precious metal is formed generally centrally of the contact surface so as to extend therebeyond by successive discrete extrusions of the precious metal into a preselected configuration comprising the projection. A free end portion on the projection is spaced from the contact surface and comprises a chordal section of a sphere.

4 Claims, 4 Drawing Sheets

ELECTRICAL CONTACT HAVING A PRECIOUS METAL EXTRUSION EXTENDING FROM A CONTACT SURFACE

This is a Divisional, of application Ser. No. 07/475,916 filed Feb. 6, 1990, now U.S. Pat. No. 5,020,217.

FIELD OF THE INVENTION

This invention relates in general to electrical devices and in particular to an electrical contact, a method of fabricating an electrical contact, and a method of fabricating an electrical contact and securing it to a continuous strip of a generally thin electrical conductive material.

BACKGROUND OF THE INVENTION

In the past, various different methods have been employed to fabricate electrical contacts and to provide contact surfaces on such electrical contacts having various different configurations.

One of the aforementioned past fabricating methods utilized an electrical contact of the composite type, and such electrical contact included a generally circular base formed of copper or a copper alloy and having a pair of opposite faces, a stem integral with the base and extending therefrom, and a layer of a noble or precious metal overlaying the other of the opposite faces and defining a contact surface on the electrical contact. The base, stem and contact surface of the electrical contact each extended about a centerline axis of the electrical contact.

In the past fabricating method of the aforementioned electrical contact, an ultrasonically actuated die was engaged with the contact surface of such electrical contact, and a cavity in such die was located generally about the centerline axis of such electrical contact. Of course, in response to the ultrasonic actuation of the die, the die was moved or jiggled with a random reciprocal or back and forth movement against the precious metal of the contact surface, and some of the precious metal was randomly scraped or scrubbed from the contact surface into the die cavity in response to the random movement of the ultrasonically actuated die. When the die was deactuated and disengaged from the contact surface, the precious metal which had been scrubbed from the contact surface into the die cavity defined a precious metal projection extending generally about the centerline axis of the electrical contact to a preselected height beyond the contact surface. The configuration of the precious metal projection conformed to that of the die cavity, and the free end portion of the precious metal projection defined a chordal section of a sphere having a spherical radius in a range between 0.004 and 0.007 inches with a centerpoint on the centerline axis of the electrical contact, and the aforementioned preselected height of the precious metal projection beyond the contact surface was in a range between 0.0025 and 0.0040 inches.

The above discussed prior art electrical contact was utilized in a prior art electrical device, such as for instance a push button switch or a cold control or the like. During the manufacture of the prior art electrical devices, foreign particles, such as for instance dust or metallic particles were found to be present, and it was believed that such foreign particles may have had a deleterious affect upon the making engagement of the prior art electrical contact with a cooperating stationary contact upon the energization of the electrical device. To counteract the presence of the foreign particles, a stream of ionized air was injected into the electrical device and passed over both the prior art electrical contact and the cooperating stationary contact. The effect of the ionized air stream was to displace the foreign particles of a size in excess of about 2 mils from the prior art electrical contact and the cooperating stationary contact; however, it was found that foreign particles of a size greater than about 1 mil and less than about 2 mils remained in place in engagement with both the prior art electrical contact and the cooperating stationary contact.

When the prior art electrical contact was moved into making engagement with the cooperating stationary contact upon the energization of the electrical device, the precious metal projection extending beyond the contact surface of the prior art electrical contact was abutted in circuit making engagement with the contact surface on the cooperating stationary contact. Thus, current was flowed through the precious metal projection between the prior art electrical contact and the cooperating stationary contacts and the circuit making engagement of the precious metal projection with the contact surface of the cooperating stationary contact effected a predetermined spacing apart of the respective contact surfaces on the prior art electrical contact and the cooperating stationary contact. Assuming that the electrical device was energized at 110 volts when the prior art electrical contact and the cooperating stationary contact were in circuit making engagement, as discussed above, the preselected height of the precious metal projection (i.e. between 0.0025 inches and 0.0040 inches) extending beyond the contact surface of the prior art electrical contact was great enough to accommodate the presence of the foreign particles sized greater than about 1 mil and less than about 2 mils which remained on the respective contact surfaces of the prior art electrical contact and the cooperating stationary contact subsequent to the above discussed introduction of the ionized air stream into the electrical device.

When the prior art electrical contact and the cooperating stationary contact were disposed in circuit making engagement in the manner discussed hereinabove, the accommodation of the foreign particles sized greater than about 1 mil and less than about 2 mils between the respective contact surfaces of the prior art electrical contact and the cooperating stationary contact was particularly important within a designated "sphere of influence" between such contact surfaces. This designated "sphere of influence" extending between the contact surfaces of the prior art electrical contact and the cooperating stationary contact was defined within a generally circular area on the contact surface of the prior art electrical contact about the centerline axis thereof where foreign particles sized in excess of about 2 mils might have lodged between the respective contact surfaces of the prior art electrical contact and the cooperating stationary contact to prevent the circuit making engagement therebetween. The "sphere of influence" is a function of the curvatures or radii of the respective contact surfaces on the prior art electrical contact and the cooperating stationary contact and also the spherical radius of the chordal section of the sphere defined on the free end of the precious metal projection on the prior art electrical contact.

Even though the prior art electrical contact was fabricated by a method utilizing an ultrasonically actuated die in the manner discussed hereinabove, one of the disadvantageous or undesirable features of such fabrication method is believed to be that the cycle time of the ultrasonically actuated die to form one of the prior art electrical contacts was too slow and therefore too expensive from the view of manufacturing or fabricating time. Another disadvantageous or undesirable feature of the above discussed fabrication method is believed to be that the ultrasonic equipment necessary to actuate the die was not only too expensive as an initial or capital investment but also was too expensive to operate from the viewpoint of equipment shut down for necessary maintenance and repairs. Further, another disadvantageous or undesirable feature of the past fabrication method is believed to be that wear on the ultrasonically actuated dies was excessive necessitating frequent replacement thereof.

SUMMARY OF THE INVENTION

Among the several objects of the present invention may be noted the provision of an improved electrical contact, an improved method of fabricating an electrical contact, and an improved method of fabricating an electrical contact and securing it to a continuous strip of generally thin electrical conductive metallic material which overcome the above discussed disadvantageous or undesirable features, as well as others, of the prior art; the provision of such improved electrical contact and methods wherein the electrical contact is formed at least in part of a precious metal with the precious metal defining a contact surface on the electrical contact and wherein a projection of the precious metal extending a preselected height beyond the contact surface is created by successive discrete extrusions or deformations of the precious metal with respect to the contact surface; the provision of such improved electrical contact and methods wherein the extension of the precious metal projection in response to the initial extrusion of the precious metal from the contact surface is subsequently altered to attain the preselected height of the precious metal extension by a successive discrete extrusion or deformation of at least the precious metal projection; the provision of such improved electrical contact and methods wherein a preselected base area of the precious metal projection is established and maintained in response to the successive discrete deformations of the precious metal into the precious metal projection; the provision of such improved electrical contact and methods in which a plurality of the precious metal projections are formed within a preselected central area on the contact surface in response to the successive discrete deformation of the precious metal; the provision of the improved methods wherein the securement of the electrical contact to the strip of electrically conductive metallic material occurs at least generally simultaneously with the successive discrete deformation of at least the precious metal projection to alter its extension to the preselected height beyond the contact surface; the provision of such improved methods wherein the successive discrete extrusions of the precious metal projection on the electrical contact are respectively effected by separate die sets at separate work stations; and the provision of such improved electrical contact and methods in which the components utilized therein are simplistic in design, economically manufactured and easily assembled. These as well as other objects and advantageous features of the present invention will be in part apparent and in part pointed out hereinafter.

In general, an electrical contact in one form of the invention has a body formed at least in part of a precious metal with the precious metal defining a contact surface on the body. At least one projection of the precious metal is formed at least generally centrally of the contact surface so as to extend therebeyond by successive discrete extrusions of the precious metal into a preselected configuration comprising the at least one projection.

Also in general and in one form of the invention, a method is provided for fabricating an electrical contact formed at least in part of a precious metal with the precious metal defining a contact surface on the electrical contact. In practicing this method, an initial discrete deformation of the precious metal is created, and at least one projection of the precious metal is extended to a preselected height beyond the contact surface in response to the initial discrete deformation of the precious metal. Thereafter, a further discrete deformation of at least the at least one projection into a preselected configuration is effected, and the extension of the at least one projection is altered to another preselected height beyond the contact surface different than the first named preselected height in response to the further discrete deformation of at least the at least one projection.

Further in general, a method is provided in one form of the invention for fabricating an electrical contact and securing it to a continuous strip of a generally thin electrical conductive metallic material, and the electrical contact includes a base having a pair of generally opposite faces, a precious metal overlaying one of the opposite faces and defining a contact surface on the electrical contact, and a stem integral with the other of the opposite faces. In practicing this method, at least one opening is provided in the strip, and the stem of the electrical contact is inserted into the at least one opening so as to dispose the other opposite face on the base at least adjacent the strip about the one opening. The precious metal is initially deformed, and an extrusion of the precious metal is extended to a preselected height beyond the contact surface when the precious metal is initially deformed. Thereafter, at least the precious metal extrusion is further deformed into a preselected configuration, and the extension of the precious metal extrusion is increased to another preselected height beyond the contact surface greater than the first named preselected height in response to the further deformation of at least the at least one projection. A part of the stem is swedged into retaining and electrical conductive engagement with the strip about the one opening thereby to secure the strip between the other opposite face and the stem part at least generally simultaneously with the occurrence of the further deformation of at least the at least one projection.

Additionally and in one form of the invention, a method is provided for fabricating an electrical contact and securing it to a continuous strip of generally thin electrical conductive metallic material, and the electrical contact includes a base having a pair of generally opposite faces, a precious metal overlaying one of the opposite faces and defining a contact surface on the electrical contact, and a stem integral with the other of the opposite faces, the stem and base being formed of an electrical conductive metallic material different than the precious metal. In the practice of this method, at least one opening is provided through the strip, and the precious metal is initially deformed to effect an extrusion of the precious metal beyond the contact surface in excess of a preselected height. The stem on the electrical contact is inserted into the at least one opening so as to dispose the other opposite face on the base at least adjacent the strip about the at least one opening therein. At least the precious metal extrusion is further deformed into a preselected configuration, and the extension of the precious metal extrusion beyond the contact surface is reduced to the preselected height in response to the further deformation of at least the precious metal extrusion. A part of the stem is swedged into retaining and electrical conductive engagement with the strip generally about the at least one opening thereby to secure the strip between the other opposite face on the base and the stem part at least generally simultaneously with the occurrence of the further deformation of at least the precious metal extrusion.

BRIEF DESCRIPTION OF THE DRAWINGS

Corresponding reference characters refer to corresponding parts throughout the several views of the drawings.

The exemplifications set out herein illustrate the preferred embodiments of the present invention in one form thereof, and such exemplifications are not to be construed as limiting the scope of the disclosure or the scope of the invention in any manner.

DETAILED DESCRIPTION OF THE PREFERRED EMBODIMENTS

Figure 1:
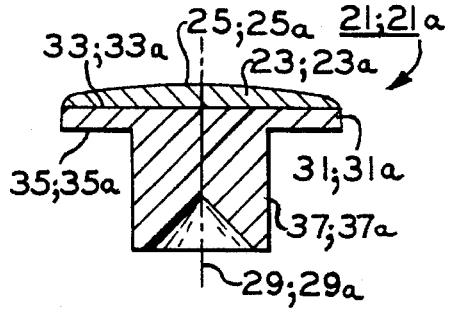
FIG. 1 is a sectional view showing an electrical contact of the composite type partially in cross-section prior to its fabrication by the fabricating methods of this invention.
Figure 5:
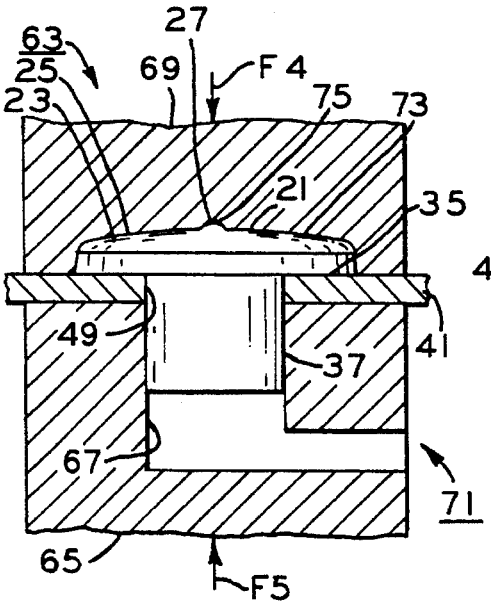
Figure 6:
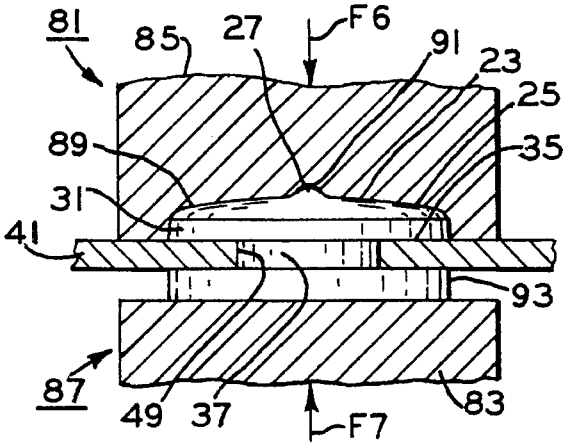
Figure 5A:
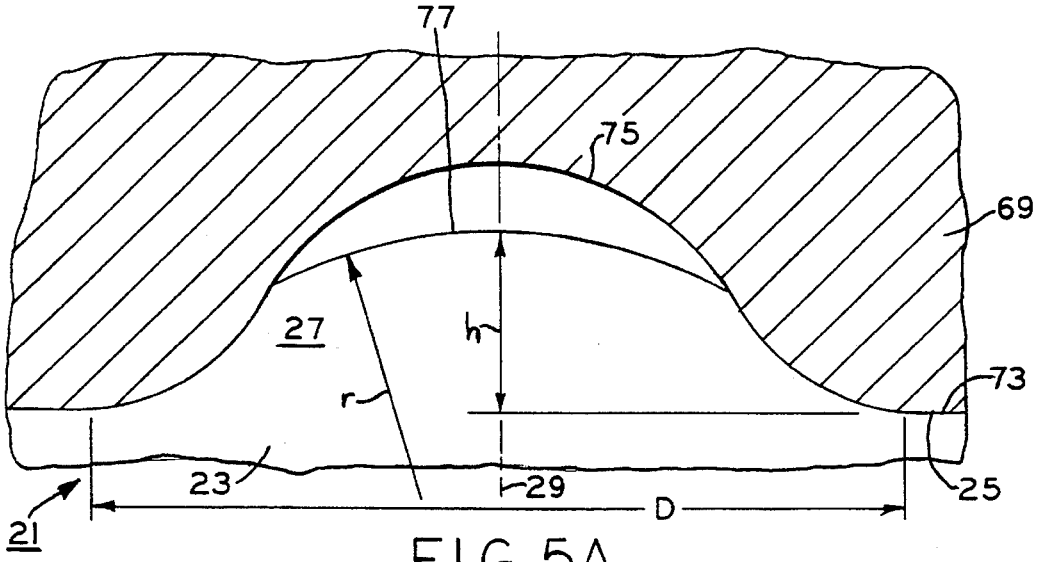
FIG. 5A is an enlarged partial sectional view showing an intermediate configuration of the electrical contact of FIG. 1 in association with a die at the work station of FIG. 5.
Figure 6A:
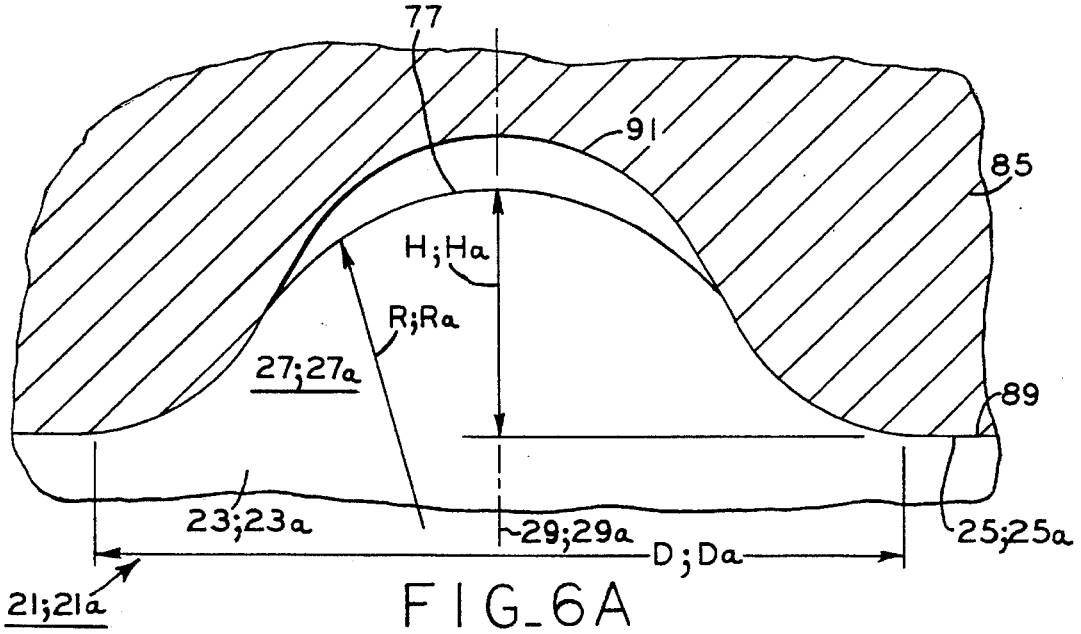
FIG. 6A is an enlarged partial sectional view showing an electrical contact in one form of the invention in association with a die at the work station of FIG. 6.

Referring now to the drawings in general, there is illustrated a method in one form of the invention for fabricating an electrical contact 21 formed at least in part of a noble or precious metal, such as for instance silver or a silver alloy or the like as indicated at 23, and with the precious metal defining a contact surface 25 on the electrical contact (FIG. 1). In the practice of this method, an initial discrete deformation of precious metal 23 is created, and at least one projection 27 of the precious metal is extended to a preselected height h beyond contact surface 25 in response to the initial discrete deformation of the precious metal (FIGS. 5 and 5A). Thereafter, a further or successive discrete deformation of at least precious metal projection 27 is effected into a preselected configuration, and the extension of the precious metal projection is altered to another preselected height H beyond contact surface 25 different than preselected height h in response to the further discrete deformation of at least the precious metal projection (FIGS. 6 and 6A).

More particularly and with specific reference to FIG. 1, contact 21 may be of the composite type, if desired, and formed at least generally concentrically about a centerline axis 29. In its original configuration, electrical contact 21 is provided with a body including generally cylindric base 31 having a pair of generally opposite faces 33, 35, and precious metal 23 is layered in overlaying relation on opposite face 33 so as to be secured thereto against displacement. As previously mentioned, precious metal 23 defines contact surface 25 on electrical contact 21, and the contact surface has a generally arcuate configuration when viewed in cross-section with a radius in a range between about 0.360 inches and 0.390 inches having a centerpoint on centerline axis 29 while base 31 has a diameter intersecting centerline axis 29 in a range between about 0.154 inches and about 0.158 inches, A stem 37 is integrally formed with base 31 extending from opposite face 35 thereof, and the base and stem are integrally formed of an electrical conductive metallic material, such as for instance copper or a copper alloy or the like, which is, of course, different than precious metal 23.

As previously mentioned, a plurality of work stations are respectively illustrated in FIGS. 2–7, and if desired, such work stations may be successively associated with each other in any suitable multiple die set or automatic machine of a type well known to the art, such as a Multi-slide model 28 available from U.S. Baird Corp., Stratford, Conn. or the like for instance; however, for the sake of brevity of disclosure and drawing simplicity, the details of such multiple die set or automatic machine are omitted except for the specific operation occurring at the work stations shown in FIGS. 2–7, respectively, as discussed in detail hereinafter.

Figure 2:
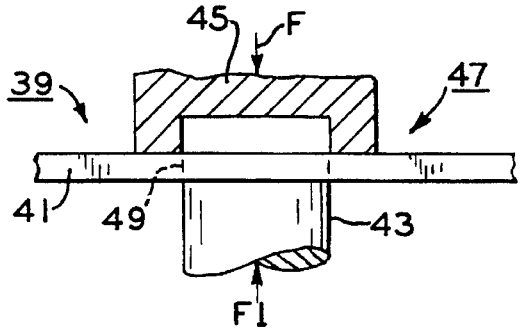
FIGS. 2–7 are partial sectional views showing the operations of a plurality of die sets located at a plurality of successive work stations and illustrating principles which may be practiced in a method of fabricating an electrical contact in one form of the invention and a method of fabricating an electrical contact and securing it to a continuous strip of a generally thin electrical conductive metallic material also in one form of the invention, respectively.

At a work station 39 indicated generally in FIG. 2, a continuous strip 41 of a generally thin electrical conductive metallic material having the desired electrical and physical properties, such as for instance beryllium copper or the like, is successively moved or indexed from a supply thereof (not shown) so as to be received in an indexed position between a punch die 43 and a back-up die 45 defining an aligned die set 47. Back-up die 43 is protractively moved from an at-rest position (not shown) by a force F, as indicated by the force arrow shown in FIG. 2, into a protracted position disposed in back-up relation at least adjacent strip 41, as shown in FIG. 2, and then punch die 43 is protractively driven or actuated relative to back-up die 43 by a force F1, as indicated by the force arrow in FIG. 2, from an at-rest position (not shown) into a protracted position shown in FIG. 2 thereby to punch an opening 49 through strip 41 at a preselected indexed location lengthwise along the strip. The punched opening 49 is provided in strip 41 to receive stem 37 of electrical contact 21 in a manner discussed hereinafter with respect to another work station 51 shown in FIG. 3.

Figure 3:
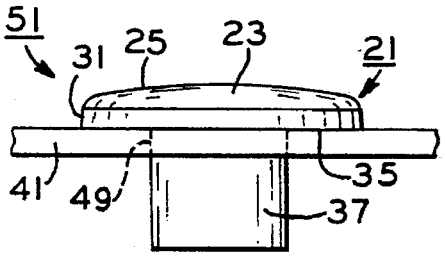

Subsequent to the punching of opening 49 in strip 41, as discussed above, punch die 43 and back-up die 45 are respectively retractively moved their at-rest positions (not shown) to permit the indexed movement of the strip through work station 39 to locate the part of the strip containing opening 49 in an indexed position at work station 51, as best seen in FIG. 3. At work station 51, stem 37 of electrical contact 21 is inserted through opening 49 in strip 41, and opposite face 35 on base 31 of the electrical contact is positioned or disposed at least adjacent the strip so as to extend generally about the opening therein. The aforementioned association of electrical contact 21 with strip 41 may be accomplished by suitable transfer or registration and assembly equipment of a type well known to the art; however, for the sake of brevity of disclosure and drawing simplification, a description of such equipment and its operation is omitted. When electrical contact 21 is associated with strip 41 so as to be carried thereby at work station 51 in the manner discussed above, the strip is indexed through work station 51 to locate the part of the strip carrying electrical contact 21 at another work station 53, as shown in FIG. 4.

At work station 53, electrical contact 21 is located in an indexed position between a swedging die 55 and a back-up die 57 defining another aligned die set 59, and the back-up die is provided with a die cavity 61 shaped so as to at least generally conform to the configuration of contact surface 25 and base 31 of the electrical contact. When electrical contact 21 is located in the indexed position thereof at work station 53, back-up die 57 is protractively driven or actuated from an at-rest position (not shown) by a force F2, as indicated by the force arrow in FIG. 4, into a protracted or back-up position disposed at least adjacent strip 41, and die cavity 61 in the back-up die is disposed in back-up or containing relation at least adjacent contact surface 25 and base 31 of the electrical contact. With back-up die 57 so disposed in its protracted position, swedging die or flathead punch 55 is also protractively driven or actuated from an at-rest position (not shown) by another force F3, as indicated by the force arrow in FIG. 4, into a protracted position shown in FIG. 4 disposed in driving or swedging engagement with the free end of stem 37 on electrical contact 21.

It may be noted that the magnitude of force F3 effecting the swedging engagement of swedging die 53 with stem 37 of electrical contact 21 is just great enough to effect only a slight swedging or deformation of the stem thereby to establish at least an interfering engagement or fit between the stem and opening 49 in strip 41. This swedged or interfering engagement between stem 37 on electrical contact 21 and opening 49 in strip 41 is provided only to ensure the retention of electrical contact 21 against displacement movement from strip 41 during further or successive indexing movements of the strip, as discussed hereinafter. Even though the above discussed swedging operation performed on electrical contact 21 at work station 53 retains the electrical contact against displacement from strip 41, it is believed that such swedging operation and work station 53 might be omitted in favor of other means for retaining the electrical contact against displacement from the strip within the scope of the invention so as to meet at least some of the objects thereof. For instance, it is believed that a close tolerance relation between stem 37 and strip opening 49 might be effective to retain electrical contact 21 against displacement from strip 41, or in the alternative, it is also believed that mechanical guide means might be employed between work station 51 and at least some of the other work stations discussed hereinafter for retaining the electrical contact against displacement from the strip.

Figure 4:
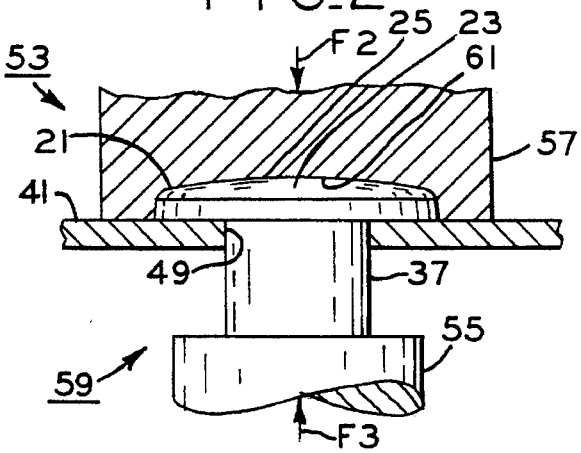

To complete the operation of die set 59 at work station 53, as described above, swedging die 55 and back-up die 57are respectively retractively moved from their respective protracted positions illustrated in FIG. 4 into their respective retracted or at-rest positions (not shown) disassociated from electrical contact 21. Upon the return of swedging die 55 and back-up die 57 to their respective at-rest positions, strip 41 is further indexed through work station 53 to locate the part of the strip carrying electrical contact 21 at another work station 63, as shown in FIG. 5.

At work station 63, electrical contact 21 is located in an indexed position aligned between a generally annular cylindric driving die 65 having a generally central recess 67 therein and a back-up or extrusion die 69 with the driving and extrusion dies defining another aligned die set 71. Extrusion die 69 is provided with a die cavity 73 shaped so as to at least generally conform to the configuration of contact surface 25 and base 31 of electrical contact 21, and a projection or extrusion cavity 75 is also provided in the extrusion die so as to open into the die cavity generally centrally thereof. With electrical contact 21 located in its indexed position at work station 63, extrusion die 69 is protractively moved or actuated from an at-rest position (not shown) by a force F4, as indicated by the force arrow in FIG. 5, into a protracted or back-up position disposed at least adjacent strip 41, and die cavity 73 in the extrusion die is disposed in containing or back-up relation at least adjacent contact surface 25 and base 31 of the electrical contact. Upon the disposition of extrusion die 69 in its protracted position, driving or ram die 65 is also protractively driven or actuated from an at-rest position (not shown) by another force F5, as indicated by a force arrow in FIG. 5, into a protracted position. When so driven into its protracted position, driving die 65 is disposed in driving engagement with at least a part of strip 41 extending about opening 49 and abutted against opposite face 35 on base 31 of electrical contact 21, and stem 37 on the electrical contact is received within central recess 67 provided in the driving die. Of course, force F5 is transmitted from driving die 65 through strip 41 onto opposite face 35 on base 31 of electrical contact 21 and therefrom through the base and precious metal 23 to engage contact surface 25 on the electrical contact with the part of die cavity 73 disposed in back-up relation with the contact surface. Upon the engagement of contact surface 25 on electrical contact 21 with die cavity 73 in extrusion die 69, some of precious metal 23 on the electrical contact is extruded or deformed into projection cavity 75 of extrusion die 69 thereby to define the aforementioned initial discrete deformation or extrusion of the precious metal which initially extends precious metal projection 27 only to the preselected height h less than the preselected height H beyond contact surface 25 on the electrical contact, as best seen in FIG. 5A.

It may be noted that the initial discrete extrusion of precious metal 23 on electrical contact 21 effects the extension of precious metal projection 27 only partially into projection cavity 75 in extrusion die 69, and it is believed that fluid trapped in the projection cavity during the discrete extrusion thereinto of the precious metal prevents the extruded precious metal from essentially filling the projection cavity in the extrusion die. Further, it may also be noted that the force F5 acting on driving die 65 to effect the above discussed initial discrete deformation of precious metal 23 is limited to a magnitude which will not deleteriously affect or otherwise deform strip 41 when the strip is engaged by the driving die to effect the initial discrete extrusion of precious metal projection 27.

Of course, the above discussed initial discrete extrusion of precious metal projection 27 extends it at least generally concentrically about centerline axis 29 of electrical contact 21, and the preselected height h of such initial discrete extrusion of precious metal projection 27 beyond contact surface 25 on electrical contact 21 is in a range between about 0.002 inches and 0.0028 inches. In response to the above discussed initial discrete extrusion of precious metal projection 27, a distal or free end portion 77 is formed thereon having a preselected configuration defined at least in part by a chordal section of a sphere with a spherical radius r in a range between about 0.008 inches and about 0.012 inches, and such spherical radius r has its centerpoint located on centerline axis 29 of electrical contact 21. The initial discrete extrusion of precious metal projection 27 is also provided with a generally circular base 79 disposed at least adjacent contact surface 25 on electrical contact 21 so as to at least generally blend into the contact surface, and such generally circular base has a diameter D in a range between about 0.014 inches and about 0.030 inches with the diameter intersecting centerline axis 29 of the electrical contact.

Subsequent to the initial discrete extrusion of precious metal 23 into projection cavity 75 of extrusion die 69 as described above, driving die 65 and extrusion die 69 are respectively moved from their respective protracted positions illustrated in FIG. 5 into respective retracted or at-rest positions (not shown) disassociated from electrical contact 21. Upon the return of driving die 65 and extrusion die 69 to their respective at-rest positions, strip 41 is further indexed through work station 63 to locate the part of the strip carrying electrical contact 21 at another work station 81, as shown in FIG. 6.

At work station 81, electrical contact 21 is located in an indexed position between another swedging die or flathead punch 83 and another back-up or extrusion die 85 which define another aligned die set 87. Extrusion die 85 is provided with a die cavity 89 shaped so as to at least generally conform to the configuration of contact surface 25 and base 31 of electrical contact 21, and a projection or extrusion cavity 91 is also provided in the extension die so as to open into the die cavity generally centrally thereof. It may be noted that projection cavity 91 in extrusion die 85 has a configuration different than that of the previously mentioned projection cavity 75 in extrusion die 69, as may be compared in FIGS. 5A and 6A.

With electrical contact 21 located in its indexed position at work station 81 in FIG. 6, extrusion die 85 is protractively moved or actuated from an at-rest position (not shown) by a force F6, as indicated by the force arrow in FIG. 6, into a protracted or back-up position disposed at least adjacent strip 41, and both die cavity 89 and projection cavity 91 in the extrusion die are disposed in containing or back-up relation at least adjacent contact surface 25 and the initial discrete extrusion of precious metal projection 27 on the electrical contact, respectively. Upon the disposition of extrusion die 67 in its protracted position, swedging die 83 is also protractively driven or actuated from an at-rest position (not shown) by another force F7, as indicated by the force arrow in FIG. 6, into a protracted position shown in FIG. 6 swedging or deforming stem 37 on electrical contact 21 to provide a deformed stem flange 93 thereon, and it may be noted that a part of strip 41 extending generally about opening 49 is captured in retaining and electrical conductive engagement between deformed stem flange 93 and opposite face 35 on base 31 of electrical contact 21 thereby to secure the electrical contact to the strip against displacement.

At least generally simultaneously with the above discussed securement of electrical contact 21 to strip 41, force F7 acting on the electrical contact through swedging die 83 urges contact surface 35 on the electrical contact against the part of die cavity 89 in extrusion die 85 arranged in back-up relation with the contact surface, and at least the above discussed initially deformed precious metal projection 27 is further extruded or deformed by further extruding some of precious metal 23 on the electrical contact into projection cavity 91 in extrusion die 85 thereby to define the aforementioned successive discrete deformation or extrusion of the precious metal projection to its preselected height H beyond the contact surface on the electrical contact, as best seen in FIG. 6A.

Of course, the above discussed successive discrete extrusion or deformation of precious metal projection 23 extends it at least generally concentrically about centerline axis 29 of electrical contact 21, and the preselected height H of such precious metal projection beyond contact surface 25 on the electrical contact is extended or increased to a range between about 0.002 inches and about 0.008 inches which exceeds the above discussed preselected height h of precious metal projection 27 effected in response to the above discussed initial discrete extrusion thereof. In response to the successive discrete extrusion of precious metal projection 27 at work station 81, the shape of free end portion 77 on precious metal projection 27 is altered or reformed into another preselected configuration defined at least in part by a chordal section of a sphere with a spherical radius R in a range between about 0.004 inches and about 0.010 inches with the spherical radius R having a centerpoint on centerline axis 29 of electrical contact 21. It may also be noted that the above discussed successive discrete extrusion of precious metal projection 27 maintains the diameter D of circular base 79 substantially unchanged, i.e. in the aforementioned range between about 0.014 inches and about 0.030 inches, with the diameter intersecting centerline axis 29 of electrical contact 21; however, even though the diameter D of circular base 79 is disclosed as remaining generally unchanged, it is contemplated that such diameter D may be altered in response to the successive discrete extrusion of precious metal projection 27 within the scope of the invention so as to meet at least some of the objects thereof.

It may be noted that the force F7 acting on swedging die 83 to effect both the above discussed successive discrete extrusion of precious metal projection 27 and the swedging of stem flange 93 at work station 81 is also limited to a magnitude which will not deleteriously affect or otherwise deform strip 41 upon the capture of the part of the strip extending about opening 49 therein between stem flange 93 and opposite face 35 on base 31 of electrical contact 21. Furthermore, it may be noted that the above discussed successive discrete extrusion of precious metal projection 27 effects its extension only partially into projection cavity 91 in extrusion die 85 at work station 81, and it is believed that fluid trapped in the projection cavity prevents the extruded precious metal from filling the projection cavity in the extrusion die. However, since projection cavity 91 in extrusion die 85 at work station 81 is sized predeterminately larger than projection cavity 75 in extrusion die 69 at work station 63, the above discussed successive discrete extrusion of precious metal projection 27 in projection cavity 91 of extrusion die 85 at work station 81 permits the precious metal projection to attain its preselected height H even though the magnitude of force F7 which may be employed to actuate swedging die 83 is limited for the reasoning discussed above.

Figure 7:
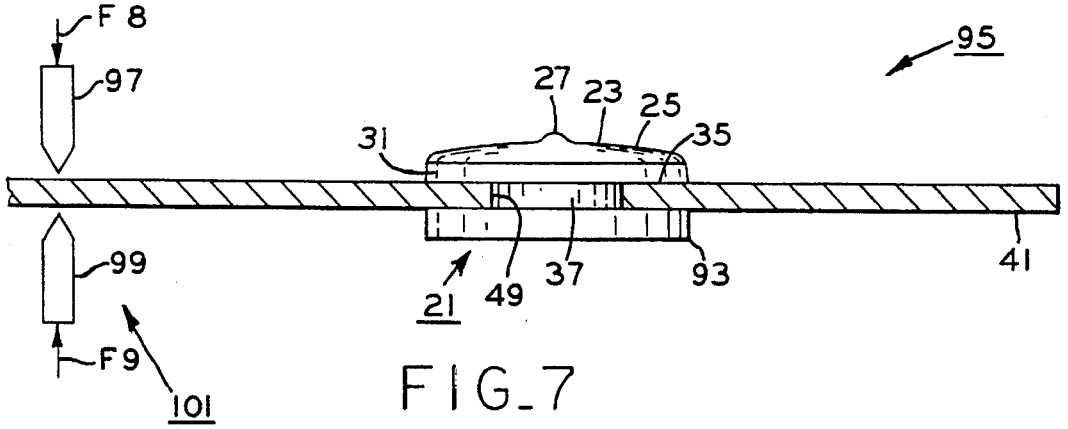

Subsequent to the further or successive discrete extrusion of precious metal 23 into projection cavity 91 of extrusion die 85 and the swedging of stem flange 93 on electrical contact 21 at work station 81, as described above, swedging die 83 and extrusion die 85 are retractively moved or returned from their protracted positions illustrated in FIG. 6 into their retracted or at-rest positions (not shown) disassociated from the electrical contact, respectively. Upon the return of swedging die 83 and extrusion die 85 to their respective at-rest positions, strip 41 is further advanced or indexed through work station 87 to locate the part of the strip carrying electrical contact 21 at another work station 95, as shown in FIG. 7.

At work station 95, strip 41 is located in an indexed position between a pair of severing dies 97, 99 which define another aligned die set 101. Severing dies 97, 99 are protractively moved from an at-rest position illustrated in FIG. 7 by forces F8 and F9 acting thereon, as indicated by the force arrows in FIG. 7, into protracted or severing positions (not shown), respectively, and in their severing position, the severing dies sever a preselected length of strip 41 therefrom with the electrical contact 21 being secured to the severed preselected length of strip 41. Subsequent to the severance of strip 41 by severing dies 97, 99, the severing dies are returned or retractively moved from their protracted positions (not shown) into their at-rest positions disassociated from strip 41, respectively, so as to permit the next successive indexing movement of the strip into an indexed position between the severing dies. Albeit not shown for the purposes of brevity of disclosure and drawing simplification, it is contemplated that the severed preselected length of strip 41 may be formed into a desired configuration at work station 95 either before or after the above discussed operation of severing dies 97, 99 within the scope of the invention so as to meet at least some of the objects thereof.

While the dies of die sets 47, 59, 71, 87, 101 have been discussed hereinabove as being sequentially actuated, it is contemplated that the dies of at least some of such die sets may be either actuated at least generally simultaneously or activated one relative to the other within the scope of the invention so as to meet at least some of the objects thereof. It is also contemplated that strip 41 may be in part laterally moved between the dies of die sets 47, 59, 71, 87 upon the respective operations thereof within the scope of the invention so as to meet at least some of the objects thereof. Furthermore, while the operations of die sets 47, 59, 71, 81, 101 have been discussed hereinabove with respect to the fabrication of only one electrical contact 21 and its securement to strip 41 for the purposes of brevity of disclosure and drawing simplification, it is contemplated that successive ones of the electrical contacts may be indexed through such die sets so as to be fabricated along with the strip within the scope of the invention so as to meet at least some of the objects thereof.

An alternative method of fabricating an electrical contact 21*a* is illustrated in one form of the invention in FIGS. 8–12, and this alternative method effects the fabrication of the electrical contact 21*a* in generally the same manner as set out hereinbefore with respect to the fabrication of electrical contact 21 by the previously described method with the exceptions noted below. Furthermore, while the alternative method of fabricating electrical contact 21*a* is believed to meet at least some of the objects set forth hereinabove, it is also believed that the alternative method may have indigenous objects and advantageous features which will be in part apparent and in part pointed out in the following discussion of the alternative method.

The initial or original configuration of electrical contact 21*a* prior to its fabrication in accordance with the alternative method is the same as that of electrical contact 21 illustrated in FIG. 1, and for convenience of disclosure, corresponding parts of electrical contact 21*a* equivalent to those of electrical contact 21 will hereinafter be designated by the letter "a".

Figure 8:
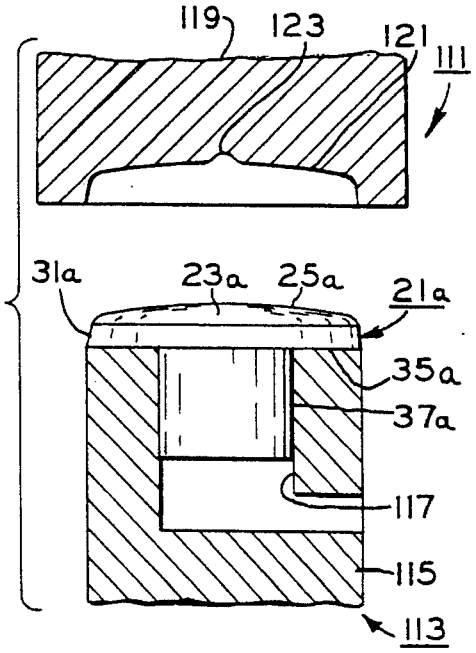
FIGS. 8–12 are partial sectional views showing the operations of a plurality of die sets located at a plurality of work stations and illustrating principles which may be practiced in an alternative method of fabricating an electrical contact in one form of the invention and a method of fabricating an electrical contact and securing it to a continuous strip of a generally thin electrical conductive metallic material also in one form of the invention, respectively.

At a work station 111 shown in FIG. 8, another aligned die set 113 includes a generally annular cylindric driving or ram die 115 having a generally central recess 117 therein and a back-up or extrusion die 119. Extrusion die 119 is provided with a die cavity 121 shaped so as to at least generally conform to the configuration of contact surface 25*a* and base 31*a* of electrical contact 21*a*, and a projection or extrusion cavity 123 is also provided in the extrusion die so as to open into the die cavity generally centrally thereof. When driving die 115 and extrusion die 119 are located in spaced apart at-rest positions at work station 111, stem 37*a* of electrical contact 21*a* is inserted into recess 117 in the driving die, and opposite face 35*a* on base 31*a* of the electrical contact is seated against the free end of the driving die about recess 117 thereby to locate the electrical contact in a preselected or located position between the driving and extrusion dies. With electrical contact 21*a* so located in its preselected position on driving die 115 at work station 111, extrusion die 119 is protractively moved from its at-rest position into a protracted or back-up position by a force F10, as best seen and as indicated by a force arrow in FIG. 9, and die cavity 121 in the extrusion die is disposed in containing or back-up relation at least adjacent contact surface 25*a* of the electrical contact in its preselected position on the driving die. Upon the disposition of extrusion die 119 in its protracted position, driving die 115 is protractively driven or actuated from its at-rest position by another force F11, as indicated by the force arrow in FIG. 9, relative to the extrusion die. When so driven by force F11, the force is transmitted from the driving die through the seating engagement of its free end with opposite face 35*a* on base 31*a* of electrical contact 21*a* to urge contact surface 35*a* on the electrical contact into engagement with the part of die cavity 121 seated in back-up relation with the contact surface. Upon the engagement of contact surface 25*a* on electrical contact 21*a* with die cavity 121 in extrusion 119, some of precious metal 23*a* on the electrical contact is extruded or deformed into projection cavity 123 thereby to define the aforementioned initial discrete deformation or extrusion of the precious metal which initially extends precious metal projection 27*a* to a preselected height ha beyond contact surface 25*a* on the electrical contact, as best seen in FIG. 9A, and it may be noted that the preselected height ha is predeterminately in excess of a final preselected height Ha desired for precious metal projection 27*a*, as discussed in greater detail hereinafter.

It may be noted that the projection cavity 123 in extrusion die 119 at work station 111 in the alternative method is configured so as to be predeterminately larger in size than either of projection cavities 75, 91 in extrusion dies 69, 85 utilized at work stations 63, 81 of FIGS. 5 and 6, respectively, in the previously discussed method; therefore, it may also be noted that the initial discrete extrusion of precious metal 23*a* into projection cavity 123 provides precious metal projection 27*a* on electrical contact 21*a* which is larger in size than the successive discrete extrusion of precious metal projection 27 formed on electrical contact 21 in the previously discussed method. Further, since electrical contact 21*a* is engaged directly between driving and extrusion dies 115, 119 of FIG. 9 in this alternative method, it may be noted that the magnitudes of forces F11, F10 respectively acting on driving and extrusion dies 115, 119 are predeterminately greater than the magnitudes of either the forces F4, F5 respectively acting on driving and extrusion dies 65, 69 of FIG. 5 or the forces F6, F7 respectively acting on swedging and extrusion dies 83, 85 of FIG. 6 in the previously discussed method. In other words, forces F11, F10 respectively acting on driving and extrusion dies 115, 119 of FIG. 9 in this alternative method may be of the aforementioned greater magnitude since such greater force magnitudes are limited only by the strengths of the metals of which electrical contact 21*a* is formed and are not limited in order to prevent the undesirable deformation of strip 41 during the fabrication of the electrical contact 21 by either of die set 71 of FIG. 5 or die set 87 of FIG. 6 in the previously discussed method.

Figure 9:
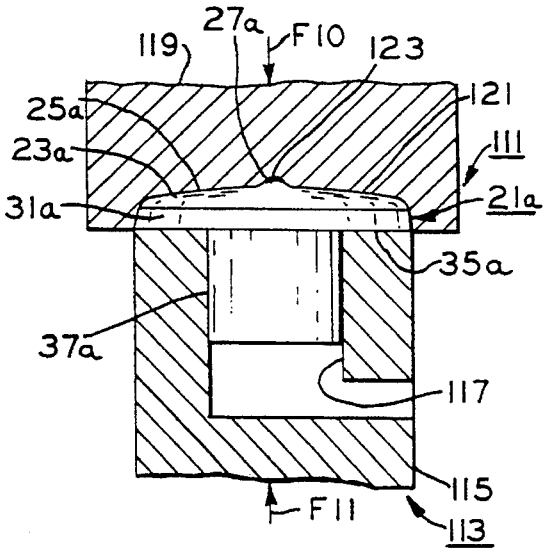
Figure 9A:
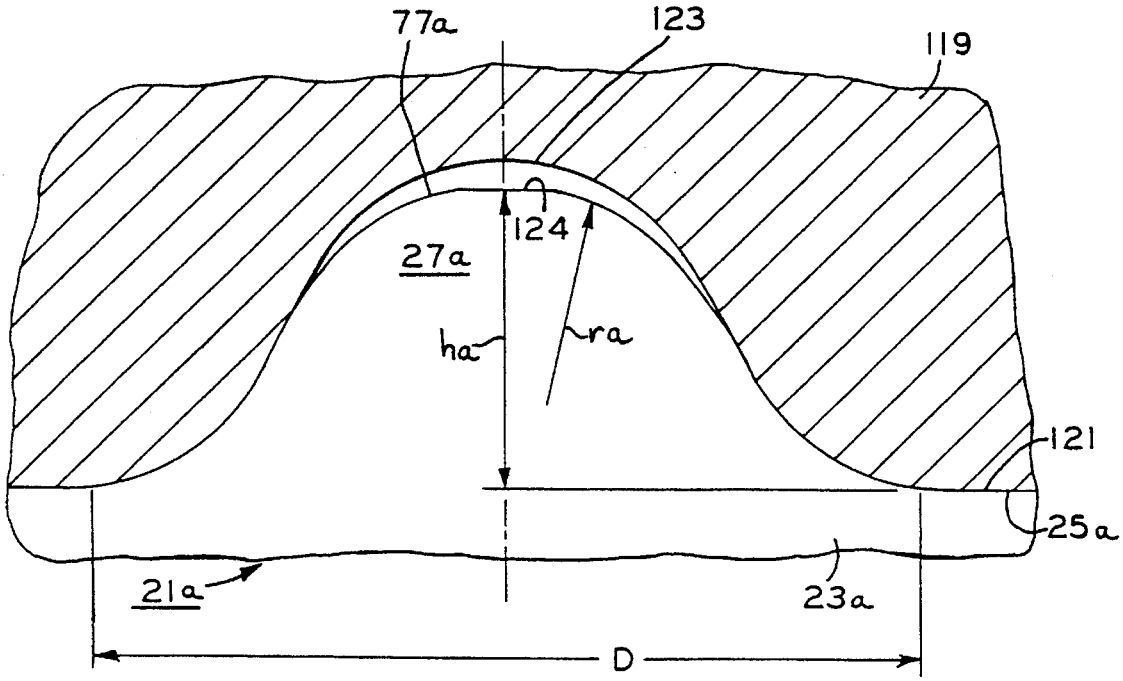
FIG. 9A is an enlarged partial sectional view showing an intermediate configuration of the electrical contact of FIG. 1 in association with an extrusion die at FIG. 9.

Even though the forces F11, F10 respectively acting on driving and extrusion dies 115, 119 in FIG. 9 may be of the above discussed greater magnitude to effect the initial discrete extrusion of precious metal projection 27*a* to the preselected height ha beyond contact surface 25*a* on electrical contact 21*a*, it may be noted that the precious metal projection extends only partially into projection cavity 123 of extrusion die 119, as best seen in FIG. 9A, and it is believed that fluid is trapped in the projection cavity during the above discussed initial discrete extrusion thereinto of precious metal 23*a* prevents the extruded precious metal from essentially filling the projection cavity in the extrusion die.

Of course, the above discussed initial discrete extrusion of precious metal projection 27*a* extends it at least generally concentrically about centerline axis 29*a* of electrical contact 21*a*, and the preselected height ha of such initial discrete extrusion beyond contact surface 25*a* on the electrical contact is in a range between about 0.005 inches and about 0.010 inches. In response to the above discussed initial discrete extrusion of precious metal projection 27*a*, a distal or free end portion 77*a* is formed thereon having a preselected configuration defined at least in part by a chordal section of a sphere with a spherical radius ra in a range between about 0.010 inches and about 0.015 inches, and such spherical radius ra has its centerpoint located on axis 29*a* of electrical contact 21*a*. However, upon the initial discrete extrusion of precious metal projection 27*a*, it may be noted that an undesirable flat 124 is formed on the chordal section of the sphere defining free end portion 77*a* of the precious metal projection. The initial discrete extrusion of precious metal projection 27*a* is also provided with a generally circular base 79*a* disposed at least adjacent contact surface 25*a* on electrical contact 21 so as to at least generally blend into the contact surface, and such generally circular base has a diameter Da in a range between about 0.014 inches and about 0.030 inches with the diameter intersecting centerline axis 29a of the electrical contact.

Either before, after or substantially simultaneously with the initial discrete extrusion of precious metal projection 27*a* on electrical contact 21*a*, opening 49 may be punched into strip 41 at work station 39 of FIG. 2 in the same manner as previously discussed hereinabove, and the strip may then be indexed through work station 39 to an indexed position located at another work station 125 illustrated in FIG. 10.

Subsequent to the initial discrete extrusion of precious metal projection 27*a* at work station 111 as discussed above, driving and extension dies 115, 119 are respectively moved from their respective protracted positions shown in FIG. 9 into their respective retracted or at-rest positions illustrated in FIG. 8. Upon the return of driving and extrusion dies 115, 119 to their respective at-rest position, electrical contact 21*a* is removed from the driving die and then transferred to work station 125 illustrated in FIG. 10 which is the same as the previously discussed work station 51 of FIG. 3.

Figure 10:
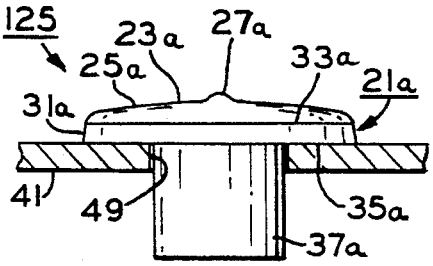

At work station 125 in FIG. 10, stem 37*a* of electrical contact 21*a* is inserted through opening 49 in strip 41, and opposite face 35*a* on base 31*a* of the electrical contact is positioned or disposed at least adjacent the strip so as to extend generally about the opening therein. When electrical contact 21*a* is associated with strip 41 so as to be carried thereby at work station 125 in the manner discussed above, the strip is indexed through work station 125 to locate the part of the strip carrying electrical contact 21*a* at another work station 127 shown in FIG. 11.

Figure 11:
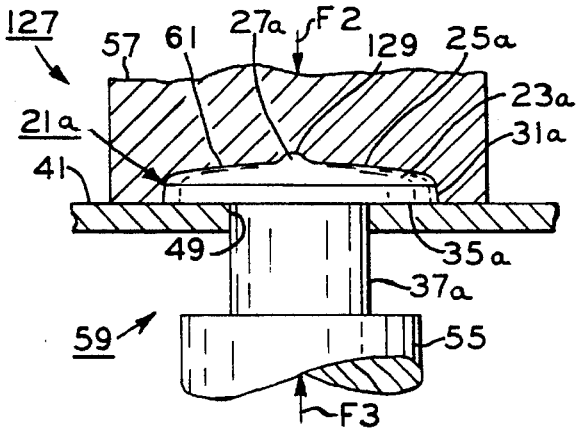

Work station 127 is the same as the previously discussed work station 53 of FIG. 4 except that extrusion die 57 is provided with a projection cavity 129 which opens generally centrally into die cavity 61; therefore, when electrical contact 21 is located at its indexed position at work station 127, back-up die 57 is protractively driven or actuated from its at-rest position (not shown) by the force F2, as indicated by the force arrow in FIG. 11, into a protracted or back-up position disposed at least adjacent strip 21, and die cavity 61 and projection cavity 129 in the back-up die are disposed in containing relation or back-up engagement about contact surface 25*a* and the initial discrete extrusion of precious metal projection 27*a*. With extrusion die 57 so disposed in its protracted position, swedging die 55 is protractively driven or actuated from its at-rest position (not shown) by force F3, as indicated by the force arrow in FIG. 11, into its protracted position shown in FIG. 11 in driving or swedging engagement with the free end of stem 37*a* on electrical contact 21*a*.

As previously noted, the magnitude of force F3 effecting the swedging engagement of swedging die 53 with stem 37*a* on electrical contact 21 is just great enough to effect only a slight swedging or deformation of the stem thereby to establish at least an interfering engagement or fit between the stem and opening 49 in strip 41. This interfering engagement between stem 37*a* and opening 49 is provided only to ensure the retention of electrical contact 21*a* against displacement movement relative to strip 41 during successive indexing movement thereof, as discussed hereinafter. Even though the swedging operation performed at work station 127 retains electrical contact 21*a* against displacement from strip 41, it is believed that work station 127 and its swedging operation might be omitted, if desired, within the scope of the invention so as to meet at least some of the objects thereof.

Figure 12:
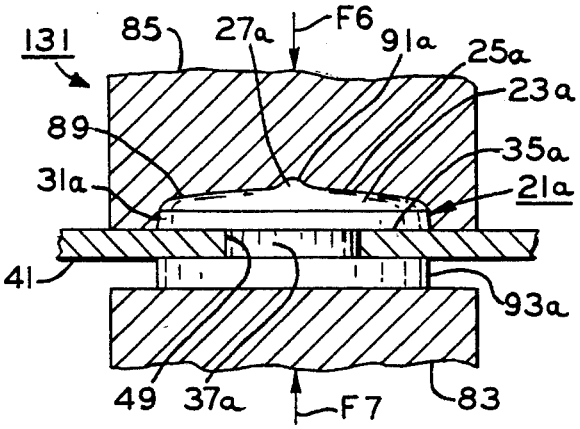

To complete the operation of die set 59 at work station 127, swedging and back-up dies 55, 57 are respectively retractively moved from their protracted positions illustrated in FIG. 11 into their respective retracted or at-rest positions (not shown) disassociated from electrical contact 21*a*, and strip 41 is further indexed through work station 127 to locate the part of the strip carrying the electrical contact in another indexed position at another work station 131, as shown in FIG. 12.

Work station 131 is the same as the previously discussed work station 81 of FIG. 6 having the same components utilized in the same manner with the exceptions noted hereinbelow. With electrical contact 21*a* located in its indexed position on strip 41 at work station 131, extension die 85 is protractively moved or actuated from an at-rest position (not shown) by force F6, as indicated by the force arrow in FIG. 12, into a protracted or back-up position disposed at least adjacent strip 41, and both die cavity 89 and projection cavity 91 are disposed in containing or back-up relation at least adjacent contact surface 25*a* and the initial discrete extrusion of precious metal projection 27*a* on the electrical contact. Upon the movement of extrusion die 85 into its protracted position, swedging die 83 is also protractively driven or actuated from an at-rest position (not shown) by force F7, as indicated by the force arrow in FIG. 12, into a protracted position shown in FIG. 12 swedging or deforming stem 37*a* on electrical contact 21*a* to provide a deformed stem flange 93*a* thereon, and it may be noted that a part of strip 41 extending generally about opening 49 is captured in retaining and electrical conductive engagement between the deformed stem flange 93*a* and opposite face 35*a* on base 31*a* of electrical contact 21*a* thereby to secure the electrical contact to the strip against displacement.

At least generally simultaneously with the above discussed securement of electrical contact 21*a* to strip 41, force F7 acting on the electrical contact through swedging die 83 urges contact surface 25*a* on the electrical contact into engagement with the part of die cavity 89 in extrusion die 85 disposed in back-up relation with the contact surface, and the initial discrete extrusion of precious metal projection 27*a* is also urged at least in part into engagement with projection cavity 91 in the extrusion die. Since the initial discrete extrusion of precious metal projection 27*a* is sized to be predeterminately larger than projection cavity 91 in extrusion die 85, as previously discussed, the engagement of projection die cavity 91 and the initial discrete extrusion of precious metal projection 27*a* effects a successive discrete extrusion of precious metal projection 27*a* which serves to alter its configuration and reduce its size. Of course, precious metal 23*a* extruded or displaced from precious metal projection 27*a* in response to its size reduction during its successive discrete extrusion is believed to flow into precious metal 23*a* defining contact surface 25*a* so as to at least generally blend into the configuration of the contact surface adjacent the successive discrete extrusion of precious metal projection 27*a*. It may be noted that free end portion 77*a* is reformed on precious metal projection 27*a* thereby to remove the aforementioned undesirable flat 124 upon the successive discrete extrusion of the precious metal projection. In this manner, the reformed or redeformed precious metal projection 27*a* has its free end portion 77*a* defining a chordal section of a sphere having a spherical radius Ra in a range between about 0.004 inches and 0.007 inches with the spherical radius Ra having its centerpoint on centerline axis 29*a* of electrical contact 21*a*. As previously discussed, it is believed that fluid is trapped in projection cavity 129 of extrusion die 85 thereby to prevent precious metal 23*a* from filling such projection cavity in response to the successive discrete extrusion of precious metal projection 27*a*.

The above discussed successive discrete extrusion or deformation of precious metal projection 27*a* extends it generally concentrically about centerline axis 29*a* of electrical contact 21*a*, and the preselected height ha of the initial discrete extrusion of precious metal projection 27*a* is reduced to the preselected height H in response to the successive discrete extrusion of precious metal projection 27*a* at work station 131. The dimensional ranges previously discussed for the predetermined height H, the spherical radius R, and the diameter D of circular base 79 of electrical contact 21 are at least generally the same for the predetermined height Ha, the spherical radius Ra and the diameter Da of electrical contact 21*a*. While the above discussed dimensional ranges relating to electrical contacts 21, 21*a* are set out herein for purposes of disclosure, it is contemplated that such ranges may be afforded other dimensional values for other electrical contacts fabricated in accordance with the methods set out herein within the scope of the invention so as to meet at least some of the objects thereof. As illustrated herein, the initial and successive discrete extrusions of precious metal projections 27, 27*a* on electrical contacts 21, 21*a* provide such precious metal projections with the preselected configuration illustrated herein for purposes of disclosure; however, it is contemplated that other electrical contacts may be formed to provide other precious metal projections thereon having various configurations different than that of precious metal projections 27, 27*a* within the scope of the invention so as to meet at least some of the objects thereof.

Figure 13:
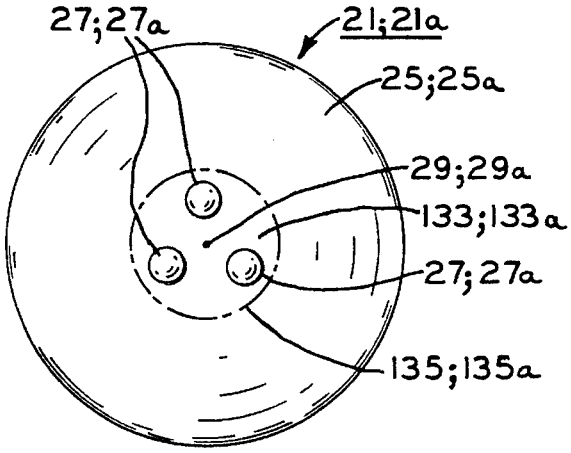
FIG. 13 is an enlarged plan view of an electrical contact in one form of the invention fabricated by the methods illustrated in either FIGS. 2–7 or FIGS. 8–12 and showing a plurality of precious metal projections respectively extending beyond a contact surface of such electrical contact.

With respect to FIG. 13, the above discussed methods of fabricating electrical contacts 21, 21*a* may also be employed in one form of the invention to effect the successive discrete extrusions of a plurality of precious metal projections 27, 27*a* extending beyond contact surfaces 25, 25*a* and spaced adjacent centerline axes 29, 29*a* of the electrical contacts within preselected generally circular areas 133, 133*a* shown by imaginary circular lines 135, 135*a* having centerpoints on the centerline axes so as to define the aforementioned "sphere of influence" when the electrical contacts are made in electrical contacting engagement with cooperating electrical contacts (not shown). Of course, in order to effect the successive discrete extrusions of the plurality of precious metal projections 27, 27*a* on electrical contacts 21, 21*a*, as shown in FIG. 13, it would be necessary to provide additional projection cavities 75, 91, 123 and to reposition them in extrusion dies 69, 85, 119, respectively, for the extrusion operations performed in the above discussed methods of fabricating electrical contacts. It may also be noted that when electrical contacts 21, 21*a* are provided with only one precious metal projection 27, 27*a* aligned about centerline axes 29, 29*a*, as previously described, such singular precious metal projections are also located within central areas 133, 133*a* on contact surfaces 25, 25*a* of the electrical contacts, respectively.

While electrical contacts 21, 21*a* are illustrated herein as being of the composite type having bases 31, 31*a* formed of a copper or copper alloy overlaid with precious metal 23, 23*a*, it is contemplated that other electrical contacts of the composite type may be provided with various other electrical conductive metallic materials in overlaid relation or that such electrical contacts may be formed entirely of such precious metals 23, 23*a* within the scope of the invention so as to meet at least some of the objects thereof. It is to be understood that the various dimensions expressed herein with respect to electrical contacts 21, 21*a* in their original configurations, as shown in FIG. 1, are provided merely for the purpose of disclosure, and it is contemplated that various other contacts having different original configurations and dimensions may be utilized and fabricated according to the above discussed fabricating methods within the scope of the invention so as to meet at least some of the objects thereof. Further, while precious metal projections 27, 27*a* are formed on electrical contacts 21, 21*a* by two successive discrete extrusions of precious metal 23, 23*a* in the manner discussed hereinabove, it is contemplated that such precious metal projections may be formed by utilizing at least three successive discrete extrusions of such precious metal within the scope of the invention so as to meet at least some of the objects thereof.

In the light of the above discussed methods of fabricating electrical contacts 21, 21*a* and recapitulating at least in part with respect to the foregoing, each of such electrical contacts in one form of the invention is provided with a body formed at least in part of precious metal 23, 23*a* defining contact surface 25, 25*a* on the body. At least one precious metal projection 27, 27*a* is formed at least generally centrally of contact surface 25, 25*a* so as to extend therebeyond by successive discrete extrusions of precious metal 23, 23*a* into a preselected configuration comprising the at least one precious metal projection 27, 27*a*.

In view of the foregoing, it is now apparent that novel electrical contacts 21, 21*a*, a novel method of fabricating an electrical contact, and a novel method of fabricating an electrical contact and securing it to an electrical conductive metallic material have been presented meeting the objects set out hereinbefore before, as well as others, and it is contemplated that changes may be made by those having ordinary skill in the art not only as to the precise arrangements, configurations and connections of the constructions set forth herein but also with respect to he precise order of the steps of such methods without departing from the spirit of the invention or from the scope of the invention which is illustrated by the claims which follow.

What we claim as new and desire to secure by Letters Patent of the United States is:

1. An electrical contact comprising:

a body having a centerline axis and formed at least in part of a precious metal with the precious metal defining a contact surface on said body;

a preselected generally circular area on said contact surface extending about the centerline axis and having a diameter of less than about 0.030 inches intersecting the centerline axis;

at least one projection of the precious metal projecting from within said area and extending about and centered on the centerline axis from said contact surface beyond the preselected circular area and formed by successive discrete extrusions of the precious metal into at least successive discrete initial and final configurations with the final configuration of the at least one projection having a height extending in a range of between about 0.002 inches and about 0.008 inches beyond the preselected circular area on said contact surface; and a free end portion on the at least one projection spaced from the preselected circular area on said contact surface, said free end portion comprising at least in part a chordal section of a sphere having a spherical radius in a range between about 0.004 inches and about 0.010 inches.

2. The electrical contact as set forth in claim 1 wherein the at least one projection includes a generally circular base area at least circumscribing the preselected circular area on said contact surface and having a diameter in a range of between about 0.014 inches and about 0.024 inches.

3. An electrical contact comprising:

a body having a centerline axis and formed at least in part of a precious metal with the precious metal defining a contact surface on said body;

a projection of the precious metal extending generally concentrically about the centerline axis beyond said contact surface and formed by successive discrete extrusions of the precious metal into at least initial and final configurations with the final configuration of said projection having a height extending in a range of between about 0.002 inches and about 0.008 inches beyond said contact surface at the centerline axis, said projecting from within a generally circular area on said contact surface extending about the centerline axis and having a diameter less than about 0.030 inches; and a free end portion on said projection spaced from said contact surface, said free end portion comprising at least in part a chordal section of a sphere having a spherical radius in a range between about 0.004 inches and about 0.010 inches with the spherical radius having a centerpoint on the centerline axis.

4. The electrical contact as set forth in claim 3 wherein said projection includes a generally circular base area at least adjacent said contact surface and having a diameter in a range of between about 0.014 inches and 0.024 inches intersecting the centerline axis.

* * * * *